US008942596B2

(12) United States Patent
Deguchi et al.

(10) Patent No.: US 8,942,596 B2
(45) Date of Patent: Jan. 27, 2015

(54) TRANSFER DEVICE

(75) Inventors: Hideaki Deguchi, Tenpaku-ku (JP); Keita Hironaka, Obu (JP); Yusuke Ozaki, Mizuho-ku (JP); Motoaki Mushika, Hashima (JP); Hikaru Yoshizumi, Handa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 175 days.

(21) Appl. No.: 13/618,374

(22) Filed: Sep. 14, 2012

(65) Prior Publication Data

US 2013/0106051 A1 May 2, 2013

(30) Foreign Application Priority Data

Nov. 2, 2011 (JP) ..... 2011-241201

(51) Int. Cl.

| | |
|---|---|
| ***G03G 15/08*** | (2006.01) |
| ***B65H 5/36*** | (2006.01) |
| ***G03G 15/16*** | (2006.01) |
| ***G03G 15/00*** | (2006.01) |

(52) U.S. Cl.

CPC ..... *B65H 5/36* (2013.01); *G03G 15/1665* (2013.01); *G03G 15/6558* (2013.01); *B65H 2404/56* (2013.01); *B65H 2404/61* (2013.01); *B65H 2801/06* (2013.01)

USPC ..... 399/121; 399/316; 399/317; 399/388

(58) Field of Classification Search

USPC ..... 399/121, 316, 317, 388

See application file for complete search history.

(56) References Cited

U.S. PATENT DOCUMENTS

| | | | |
|---|---|---|---|
| 7,113,734 | B2 | 9/2006 | Deguchi et al. |
| 7,346,304 | B2 | 3/2008 | Takagi |
| 7,539,446 | B2 | 5/2009 | Deguchi |
| 7,539,448 | B2 | 5/2009 | Miwa et al. |
| 8,055,171 | B2 | 11/2011 | Ueyama et al. |
| 2005/0069343 | A1 | 3/2005 | Deguchi et al. |

(Continued)

FOREIGN PATENT DOCUMENTS

| | | | |
|---|---|---|---|
| JP | 2005-128482 | A | 5/2005 |
| JP | 2006-208839 | A | 8/2006 |

(Continued)

OTHER PUBLICATIONS

Notice of Allowance issued in U.S. Appl. No. 13/617,219 mailed Nov. 6, 2013.

*Primary Examiner* — Ryan Walsh

(74) *Attorney, Agent, or Firm* — Banner & Witcoff, Ltd.

(57) ABSTRACT

In a transfer device, a flexible guide plate is disposed in a position upstream relative to a transfer position along a medium conveyance path, such that a first side of the guide plate faces to a recording medium being conveyed along the medium conveyance path. The guide plate has a downstream end portion that is angled by bending the guide plate. A support frame supports an upstream end portion of the guide plate and extends in a downstream direction beyond the downstream end portion to form an extension portion which is disposed opposite to a second side of the guide plate and toward which the downstream end portion extends obliquely downstream. The extension portion has a recess/hole formed in a position separated in an upstream direction from a first edge of the extension portion, to allow the downstream end portion to be moved without being blocked by the extension portion.

6 Claims, 3 Drawing Sheets

(56) References Cited

U.S. PATENT DOCUMENTS

| | | | | |
|---|---|---|---|---|
| 2006/0171760 | A1 | 8/2006 | Deguchi | |
| 2006/0238788 | A1 | 10/2006 | Takagi | |
| 2007/0269242 | A1 | 11/2007 | Hattori et al. | |
| 2007/0269243 | A1 | 11/2007 | Uehara et al. | |
| 2007/0269244 | A1 | 11/2007 | Miwa et al. | |
| 2008/0298859 | A1* | 12/2008 | Ueyama et al. | 399/316 |
| 2013/0108343 | A1 | 5/2013 | Deguchi et al. | |

FOREIGN PATENT DOCUMENTS

| | | | |
|---|---|---|---|
| JP | 2006-208840 | A | 8/2006 |
| JP | 2006-301490 | A | 11/2006 |
| JP | 2008-026808 | A | 2/2008 |
| JP | 2008-026809 | A | 2/2008 |
| JP | 2008-297044 | A | 12/2008 |

* cited by examiner

TRANSFER DEVICE

CROSS-REFERENCE TO RELATED APPLICATION(S)

This application claims priority from Japanese Patent Application No. 2011-241201 filed on Nov. 2, 2011, the disclosure of which is incorporated herein by reference in its entirety.

FIELD

Apparatuses consistent with one or more aspects of the present invention relate to a transfer device having a guide plate for guiding a recording medium toward an image carrying member.

BACKGROUND

A transfer device for transferring developer carried on a peripheral surface of a photoconductor drum (image carrying member) onto a recording sheet (recording medium) being conveyed along a sheet conveyance path (medium conveyance path) may include a guide plate for guiding the recording sheet toward the photoconductor drum, and an end portion of the guide plate may be bent down to increase rigidity of the guide plate. Increased rigidity of the guide plate would be expected to suppress vibrations which could be generated in the guide plate when the guide plate having been swayed down during conveyance of the sheet restores its original shape, to thereby damp noises caused by such vibrations.

SUMMARY

In the transfer device with a guide plate as mentioned above, however, when the rear end (trailing edge) of a sheet which is guided by the guide plate and fed forward comes off the downward bent end portion of the guide plate, the rear end of the sheet would tend to flop because nothing supports the rear end of the sheet from below. Such flopping of the rear end of the sheet would disadvantageously cause a poor transfer of developer and result in deterioration of the quality of an image formed on the sheet.

It is one aspect of the present invention to provide a transfer device in which flopping of a rear end (trailing edge) of a sheet (recording medium) coming off the end portion of the guide plate can be suppressed so that the quality of an image formed on the sheet can be improved.

More specifically, in one or more embodiments, a transfer device for transferring developer carried on a peripheral surface of an image carrying member onto a recording medium being conveyed along a medium conveyance path is provided which comprises a transfer unit, a flexible guide plate and a support frame. The transfer unit is disposed opposite to the image carrying member and configured to transfer the developer from the peripheral surface of the image carrying member onto the recording medium. The flexible guide plate has a first side and a second side reverse to the first side. The guide plate is disposed in a position along the medium conveyance path, upstream relative to a transfer position that is between the image carrying member and the transfer unit, such that the first side faces to the recording medium being conveyed along the medium conveyance path to guide the recording medium toward the image carrying member. The guide plate includes an upstream end portion and a downstream end portion which face in directions upstream and downstream, respectively, of the medium conveyance path. The downstream end portion is an angled portion formed by bending the guide plate. The support frame is configured to support the upstream end portion of the guide plate and to extend in a direction downstream of the medium conveyance path beyond the downstream end portion of the guide plate to form an extension portion which is disposed opposite to the second side of the guide plate and toward which the downstream end portion extends obliquely downstream. The extension portion has a first edge positioned on the medium conveyance path at a side facing in a direction downstream of the medium conveyance path. The extension portion has a recess and/or a hole formed in a position separated, in a direction upstream of the medium conveyance path, from the first edge of the extension portion, to allow the downstream end portion extending toward the extension portion to be moved without being blocked by the extension portion.

BRIEF DESCRIPTION OF THE DRAWINGS

The above and other aspects, other advantages and further features of the present invention will become more apparent by describing in detail illustrative, non-limiting embodiments thereof with reference to the accompanying drawings, in which.

DESCRIPTION OF EMBODIMENTS

Figure 1:
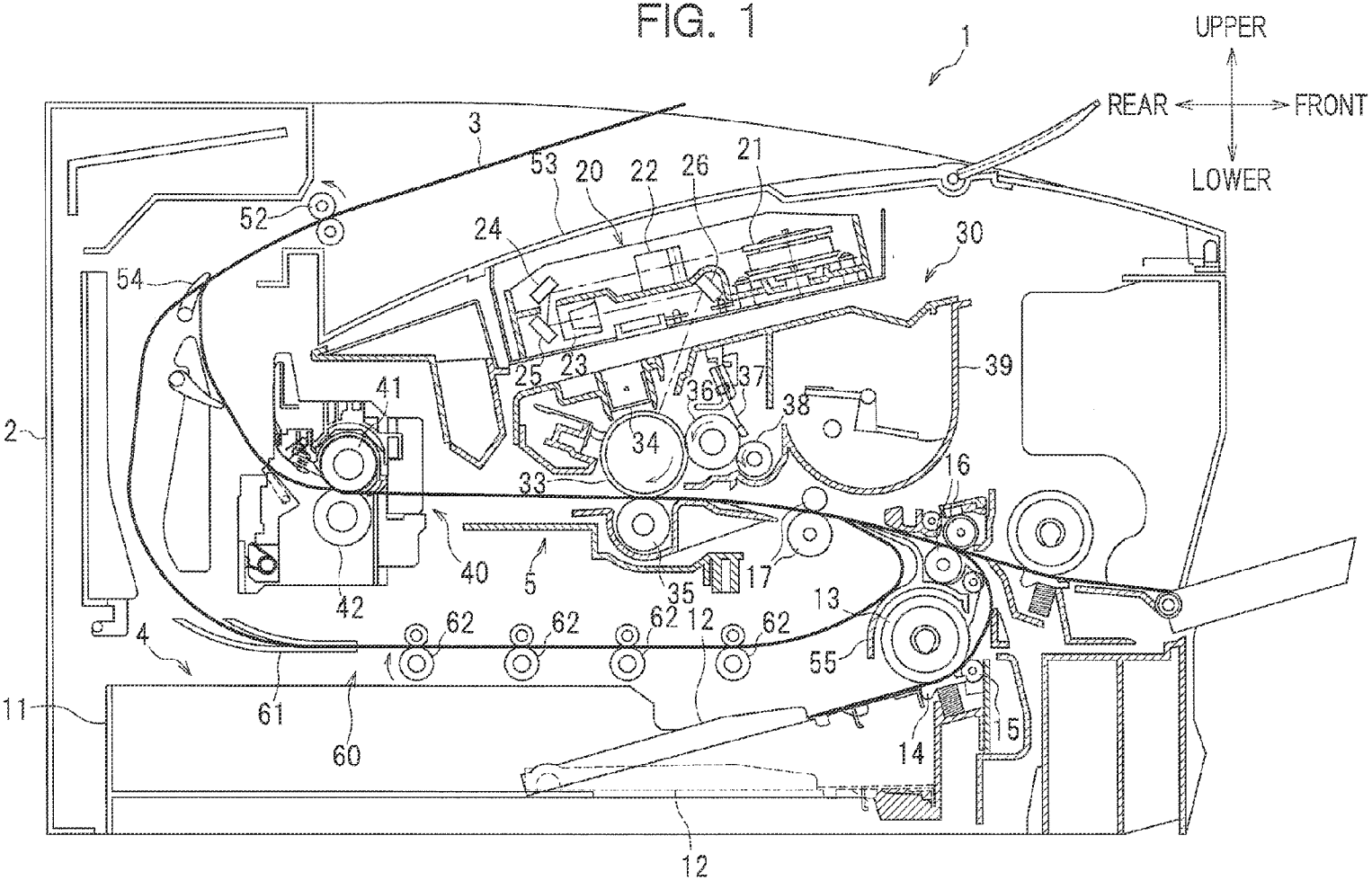
FIG. 1 is a schematic sectional view of a laser printer with a transfer device according to an illustrative embodiment of the present invention.

A detailed description will be given of illustrative, non-limiting embodiments of the present invention with reference made to the drawings where appropriate. In the following description, a general setup of a laser printer 1 with a process cartridge 30 as an example of a transfer device according to one embodiment of the present invention will be described briefly at the outset, and then features of the process cartridge 30 will be described in detail.

Hereinbelow, in describing the arrangement and operation of each component in the laser printer 1, the direction is designated as from the viewpoint of a user who is using (operating) the laser printer 1. To be more specific, in FIG. 1, the right-hand side of the drawing sheet corresponds to the "front" side of the printer, the left-hand side of the drawing sheet corresponds to the "rear" side of the printer, the front side of the drawing sheet corresponds to the "left" side of the printer, and the back side of the drawing sheet corresponds to the "right" side of the printer. Similarly, the direction of a line extending from top to bottom of the drawing sheet corresponds to the "vertical" or "up/down (upper/lower or top/bottom)" direction of the printer.

As shown in FIG. 1, the laser printer 1 comprises a body casing 2, and several components housed within the body casing 2, which principally include a sheet feeder unit 4 for feeding a sheet 3 (e.g., of paper) as one example of a recording medium, and an image forming unit 5 for forming an image on the sheet 3 fed by the sheet feeder unit 4.

The sheet feeder unit 4 includes a sheet feed tray 11 removably installed in a bottom space within the body casing 2, and a sheet pressure plate 12 provided within the sheet feed tray 11. The sheet feeder unit 4 also includes a sheet feed roller 13 and a sheet feed pad 14 which are provided above a front end portion of the sheet feed tray 11, and a paper powder remover rollers 15, 16 provided in a position downstream relative to the sheet feed roller 13 in a direction of conveyance of the sheet 3 (along a sheet conveyance path). The sheet feeder unit 4 further includes a registration roller 17 provided in a position downstream relative to the paper powder remover rollers 15, 16 in the direction of conveyance of the sheet 3 (along the sheet conveyance path).

In the sheet feeder unit 4, sheets 3 in the sheet feed tray 11 are pressed against the sheet feed roller 13 by the sheet pressure plate 12, and each sheet 3, separated from the others and forwarded by the sheet iced roller 13 and the sheet feed pad 14, is conveyed through the paper powder remover rollers 15, 16 and the registration roller 17 into the image forming unit 5.

The image forming unit 5 includes a scanner unit 20, a process cartridge 30 (transfer device) and a fixing device 40.

The scanner unit 20 is provided in an upper space within the body casing 2, and includes a laser beam emitter (not shown), a polygon mirror 21, lenses 22, 23, reflecting mirrors 24, 25, 26. The scanner unit 20 is configured to cause a laser beam to travel along a path indicated by alternate long and short dashed lines, so that a surface (peripheral surface) of a photoconductor drum 33 as an example of an image carrying member, provided within the process cartridge 30, is rapidly scanned and illuminated consecutively with the laser beam.

The process cartridge 30 is provided below the scanner unit 20 within the body casing 2, and configured to be installable in and removable from the body casing 2. The process cartridge 30 includes a photoconductor drum 33, a scorotron charger 34, a transfer roller 35 as an example of a transfer unit, a development roller 36, a doctor blade 37, a supply roller 38 and a toner hopper 39.

In the process cartridge 30, the peripheral surface of the photoconductor drum 33 is uniformly charged by the scorotron charger 34, and then exposed to a laser beam from the scanner unit 20, so that an electrostatic latent image is formed on the peripheral surface of the photoconductor drum 33. Toner as an example of developer is stored in the toner hopper 39 and supplied from the toner hopper 39 to this electrostatic latent image via the supply roller 38 and the development roller 36, so that a toner image (developer image) is formed on the peripheral surface of the photoconductor drum 33. Thereafter, while a sheet 3 is conveyed through between the photoconductor drum 33 and the transfer roller 35, the toner image carried on the peripheral surface of the photoconductor drum 33 is transferred onto the sheet 3 by a transfer bias applied to the transfer roller 35. In this way, an image is formed on the sheet 3.

The fixing device 40 is a device for thermally fixing a toner image transferred onto a sheet 3. The fixing device 40 is disposed in a position downstream relative to the process cartridge 30 on the sheet conveyance path. The fixing device 40 includes a heating roller 41, and a pressure roller 42 disposed opposite to the heating roller 41 and configured to be pressed against the heating roller 41.

A sheet 3 with a toner image thermally fixed thereon by the fixing device 40 is ejected out of the body casing 2, and placed on the sheet output tray 53, by an ejection roller 52 which is caused to rotate in a normal direction.

When images are formed on both sides of a sheet 3, the ejection roller 52 is so switched as to rotate in a reverse direction at a time before the sheet 3 is entirely ejected out onto the sheet output tray 53, and the sheet 3 is pulled back into the body casing 2. As a flapper 54 is actuated to shift its position, the sheet 3 pulled back into the body casing 2 passes along a rear side of the fixing device 40, and is forwarded into a duplex conveyance path unit 60.

The duplex conveyance path unit 60 is a return conveyance mechanism for duplex printing, and is disposed between the image forming unit 5 and the sheet feed tray 11. In this terminology, the "duplex conveyance" refers to a sheet conveyance scheme designed to return a reversed sheet 3 to a position upstream relative to the process cartridge 30 (i.e., on a guide plate 100 of FIG. 2, which will be described later in detail) so as to form an image on a back side of the sheet 3 of which a front side has an image formed thereon.

The duplex conveyance path unit 60 includes a guide member 61 and a plurality of pairs of return rollers 62. The guide member 61 is configured to receive a sheet 3 conveyed downward along the rear side of the fixing device 40, and to change a direction of conveyance of the sheet 3 from downward to frontward. The pairs of return rollers 62 are arranged in a frontward-and-rearward direction and configured to receive a sheet 3 guided (and turned frontward) by the guide member 61, and to return the sheet 3 toward a position upstream relative to the photoconductor drum 33. The sheet 3 output from the duplex conveyance path unit 60 is further guided by a guide 55 disposed in a position frontward relative to the duplex conveyance path unit 60, so that the reversed sheet 3 is forwarded toward the registration roller 17. Thus, the sheet 3 with its leading edge brought into proper alignment by the registration roller 17 is conveyed again to the photoconductor dram 33, and a toner image on the photoconductor drum 33 is transferred to the back side of the sheet 3.

Figure 2:
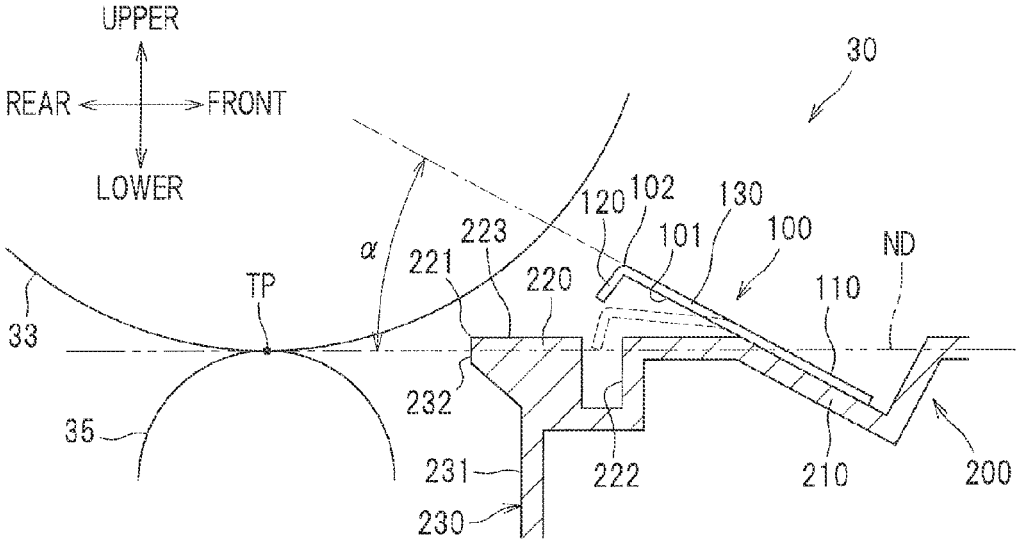
FIG. 2 is a schematic sectional view showing a structure and arrangement of and around a guide plate.
Figure 3:
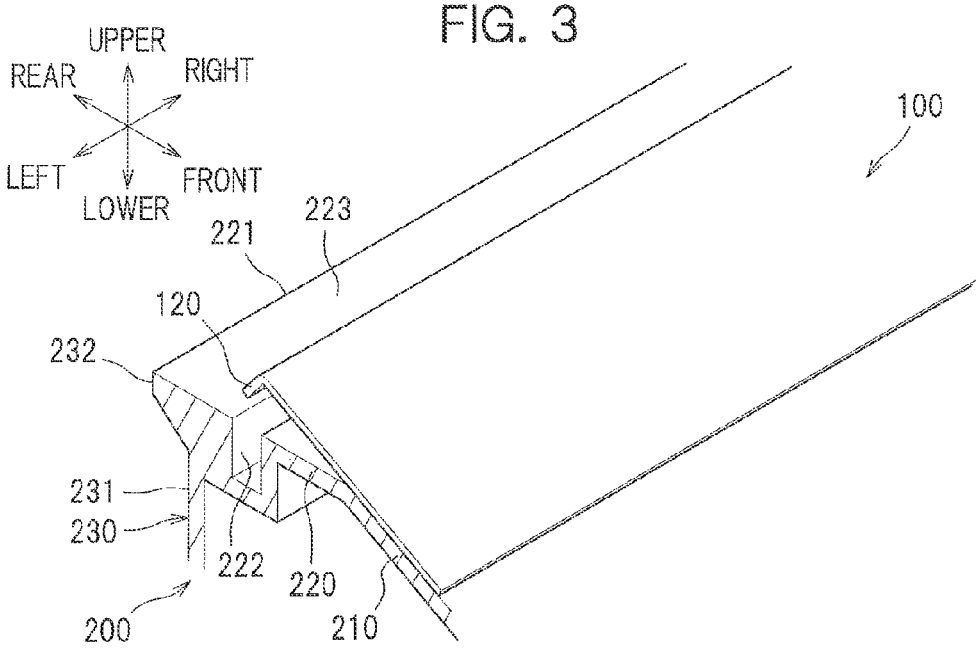
FIG. 3 is a schematic perspective view showing the structure and arrangement of and around the guide plate.

Next, referring to FIGS. 2 and 3, a detailed description will be given of a configuration of the process cartridge 30, particularly, of an arrangement around the photoconductor drum 33 and the transfer roller 35. It is to be understood that FIGS. 2 and 3 are illustrations simplified to facilitate understanding of the present invention. It is also to be understood that the specific configuration and arrangement shown in FIGS. 2 and 3 are omitted in illustration of FIG. 1 for clarity.

As shown in FIGS. 2 and 3, the photoconductor drum 33 and the transfer roller 35 are disposed opposite, facing downward and upward respectively, to each other, so that a nip contact (transfer position TP) is established between the photoconductor drum 33 and the transfer roller 35. In a position frontward of this transfer position TP (i.e., a position upstream relative to the transfer position TP along the sheet conveyance path), a guide plate 100 is provided which is a flexible plate configured and arranged to guide a sheet 3 toward the photoconductor drum 33. To be more specific, the guide plate 100 is in such an angled position that a leading edge of a sheet 3 guided by the guide plate 100 is brought into contact with the photoconductor drum 33 and then, while being kept in contact with the photoconductor drum 33, moved along the peripheral surface of the photoconductor drum 33 toward the transfer position TP. The guide plate 100 has an upper surface (shown without a reference numeral) as an example of a first side facing to the sheet 3 being conveyed along the sheet conveyance path, and an undersurface 101 reverse to the upper surface, as an example of a second side reverse to the first side.

The guide plate 100 is shaped like a plate and made of an elastically deform able and electrically insulating material, for example a resin such as polyethylene terephthalate. The material, shape and dimensions of the guide plate 100 are selected among various types of recording mediums considered to be usable in the laser printer 1 (e.g., a thin sheet of paper, a cardboard, a postcard, an OHP sheet, etc.), and the guide plate 100 to be selected may preferably be more rigid than the most flexible type and more flexible than the most rigid type. For example, in cases where polyethylene terephthalate is selected as a material of the guide plate 100, it is preferable that the thickness of the guide plate 100 be in a range of 80 μm to 200 μm. It is also considered to be preferable that the material and the shape be selected such that, for example, the product EI of the second moment of area I and the Young's modulus E be in a range of $3.49\times10^{-5}$ to $1.18\times10^{-3}$ ($N\cdot m^2$).

The guide plate 100 has a proximal end portion 110 (at an upstream end facing in a direction upstream of the sheet conveyance path) which is supported by a support frame 200, and a distal end portion 120 (at a downstream end facing in a direction downstream of the sheet conveyance path) which is free and thus allowed to rock; i.e., the guide plate 100 is configured as a cantilever. The guide plate 100 is bent, at a position (corner 102) near the downstream end of the guide plate 100, downward (toward an extension portion 220 which will be described later) whereby the distal end portion 120 thereof is angled in a direction obliquely downward and downstream of the sheet conveyance direction.

With this configuration, after the trailing edge of a sheet 3 being conveyed along the sheet conveyance path comes off the corner position (ridge line) 102 of the guide plate 100 at which the guide plate 100 is bent, the trailing edge of the sheet 3 continuously remains rested on the distal end portion 120 of the guide plate 120. Therefore, the "pre-transfer" which would result from increased separation of the sheet 3 from the photoconductor drum 33 can be prevented or reduced. Furthermore, the angled distal end portion 120 serves to smoothly guide the trailing edge of the sheet 3 to a supporting surface 223 which will be described later, and thus noises which would be produced when the trailing edge of the sheet 3 comes in contact with the supporting surface 223 can be reduced.

The tilt angle α of the guide plate 100 may be set preferably in a range of $0°<\alpha\leq45°$, more preferably in a range of $10°<\alpha\leq35°$ where the tilt angle α is an angle which a middle portion 130 (i.e., a deflectable portion between the distal end portion 120 and the proximal end portion 110) of the guide plate 100 forms with a nip position medium conveyance direction ND. Herein, the "nip position medium conveyance direction ND" refers to a direction in which an image carrying member (photoconductor drum 33) and a transfer unit (transfer roller 35) convey a recording medium (sheet 3); in cases, as in the present embodiment, where the image carrying member and the transfer unit are both configured as rollers, the nip position medium conveyance direction ND is a direction of a common tangent of these members (33, 35) in side view.

The corner (or bend) 102 of the guide plate 100 is shaped, for example, like a circular arc as viewed in cross section, as a result of bending of the guide plate 100 made to form the distal end portion 120. When duplex printing is performed, a printed side of the sheet 3 (i.e., the surface provided with irregularities formed by selectively deposited toner) slides on the cross-sectionally arc-shaped corner 102 of the guide plate 100. Therefore, noises which would be produced particularly if the printed side of the sheet 3 slides for example on an angular-shaped corner can be suppressed. The shape of the corner or bend 102 of the guide plate 100, i.e., the radius of curvature of the arc, may preferably be 0.1 mm or greater.

The support frame 200 includes a supporting portion 210 configured to support the guide plate 100, and an extension portion 220 configured to extend rearward from a rear end of the supporting portion 210. The supporting portion 210 provides a surface on which the guide plate 100 is to be supported and which forms the aforementioned tilt angle α with the nip position medium conveyance direction ND.

The extension portion 220 is disposed opposite to the underside 101 of the guide plate 100 and configured to extend rearward (in a direction downstream of the sheet conveyance path) beyond the distal end of the guide plate 100. The extension portion 220 has a rear edge 221 (as an example of a first edge positioned on the sheet conveyance path at a side facing in a direction downstream of the sheet conveyance path), and a recess 222 formed in a position separated frontward (in a direction upstream of the sheet conveyance path) from the rear edge 221 of the extension portion 220 to allow the distal end portion 120 of the guide plate 100, angled toward the extension portion 220, to be moved without being blocked by the extension portion 220. To be more specific, in the present embodiment, the recess 222 is formed as a groove extending along the length (in the leftward-and-rightward direction) of the extension portion 220 of the guide plate 100 from the left side to the right side (i.e., in the direction of the width of the sheet 3 perpendicular to the direction of conveyance of the sheet 3).

With this configuration, the supporting surface 223 of the extension portion 220, disposed rearward relative to the recess 222, that is, disposed rearward relative to the distal end of the guide plate 100, serves to support the rear end (trailing edge) of the sheet 3, with the result that flopping of the rear end (trailing edge) of the sheet 3 can be suppressed so that the quality of an image formed on the sheet 3 can be improved. Moreover, the recess 222 serves to prevent interference between the support frame 200 and the angled distal end portion 120 of the guide plate 100, with the result that the guide plate 100 can be deflected without being blocked by the support frame 200 with which the angled distal end portion 120 of the guide plate 100 would otherwise be brought into contact.

Furthermore, provision of the recess 222 allowing the distal end portion 120 to be moved without being blocked by the extended support frame 200 makes it possible to provide an elongated distal end portion 120 (having a longer length in the direction of conveyance of the sheet 3), with the result that the trailing edge of the sheet 3 can be guided to a position closer to the supporting surface 223 by the distal end portion 120.

A rear end 230 (a side facing in a direction downstream of the sheet conveyance path) of the support frame 200 includes an upper portion 232 (first end) having the rear edge 221 positioned on the sheet conveyance path, and a lower portion 231 (second end) provided in a position separate from the sheet conveyance path. The extension portion 220 is formed to protrude rearward, with the upper portion 232 of the rear end 230 being located in a position shifted rearward relative to that of the lower portion 231 of the rear end 230. Herein, the sheet conveyance path (medium conveyance path) refers to a path (space) through which a sheet 3 passes and which is defined by the guide plate 100, the supporting surface 223, the photoconductor drum 33, the transfer roller 35, and other structures (e.g., optional guide ribs or the like, not illustrated).

The extension portion 220 (i.e., a portion protruding beyond the tower portion 231 of the rear side 230) configured as described above thus serves to guide a sheet 3 to a position closer to the transfer position TP.

The present invention is not limited to the above-described specific embodiment, and it is to be understood that modifications and changes may be made to any part of the specific configuration without departing from the scope of the present invention as claimed in the appended claims. In describing modified or alternative embodiments below, the same elements will be designated by the same reference numerals and a duplicate description will be omitted.

Figure 4A:
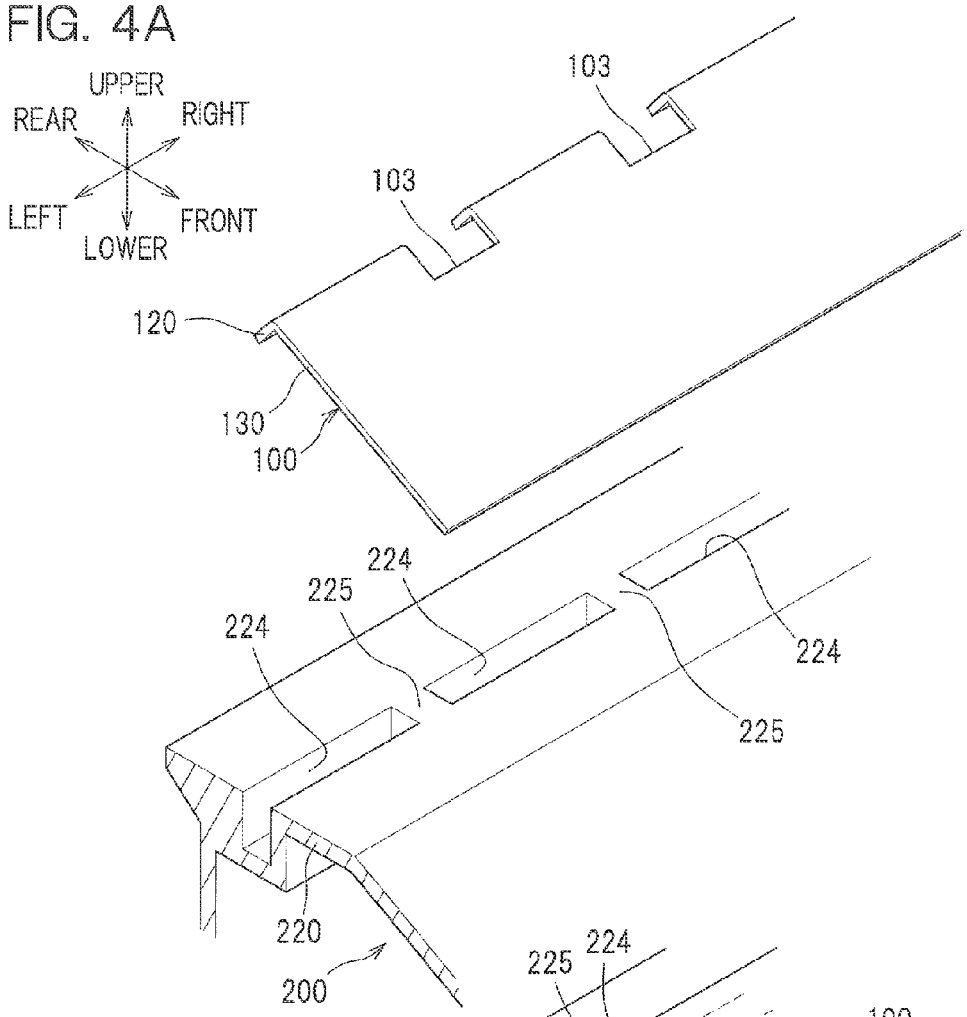
FIG. 4A is an exploded perspective view showing a modified embodiment in which a guide plate and a support frame are disassembled.
Figure 4B:
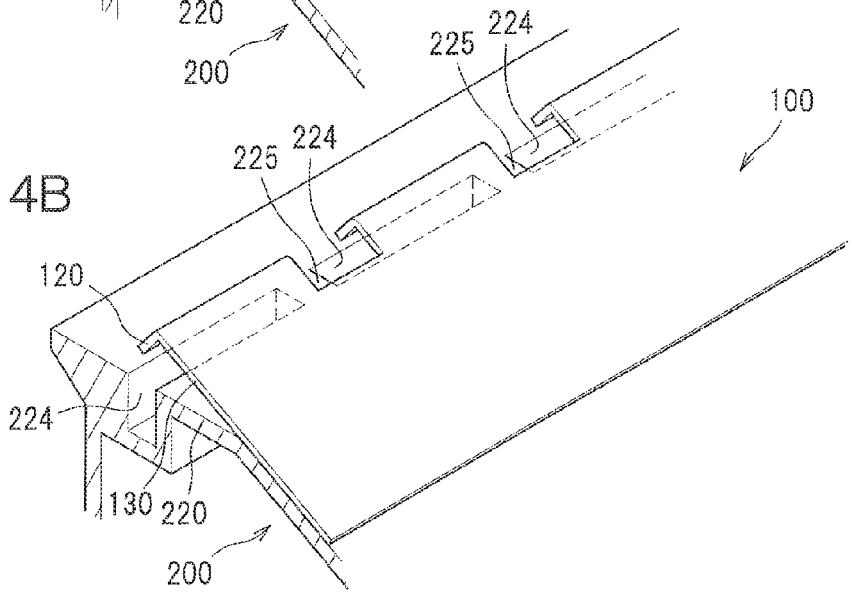
FIG. 4B is a perspective view showing the modified embodiment in which the guide plate and the support frame are assembled together.

Although the recess 222 is formed as a single groove extending along the length in the leftward-and-rightward direction in the above-described embodiment, the present invention is not limited to this specific configuration. For example, as shown in FIGS. 4A, 4B, a plurality of recesses 224 may be provided in positions spaced out in the rightward-and-leftward direction at the extension portion 220.

In this alternative embodiment, the guide plate 100 may be configured to have a plurality of indentations 103 formed in positions corresponding to those of wall portions 225 left in positions other than those of the plurality of recesses 224 (i.e., formed between adjacent recesses 224) in the extension portion 220 to allow the guide plate 100 to deflect without being blocked by the wall portions 225. To be more specific, the indentations 303 are configured to extend, for example, from the distal end of the guide plate 100 deep to appropriate positions (corresponding to the positions of the front edges of the wall portions 225) of the middle portion 130 of the guide plate 100, and each of the indentations 103 provided in the positions corresponding to the positions of the wall portions 225 is configured to extend wide enough for the guide plate 100 to avoid interference with the corresponding wall portion 225 upon deflection of the guide plate 100.

With this alternative embodiment, the recesses 224 can be reinforced by the plurality of walls 225, more rigid than the recess 222 configured according to the first embodiment as a single groove extending along the length (in the leftward-and-rightward direction) of the extension portion 220, so that the rigidity of the support frame 200 can be increased accordingly. Moreover, provision of the indentations 103 in the guide plate 100 serves to allow the guide plate 100 to deflect without being blocked by the wall portions 225.

In the above-described embodiments, a structure for allowing the distal end portion 120 of the guide plate 100 to be moved without being blocked by the extension portion 220 is illustrated as a groove-like recess 222 or recesses 224, but the present invention is not limited to these specific configurations. A similar structure may be provided, for example, as a through hole or through holes which may also be considered to be consistent with the present invention. It is thus to be understood that any recess(es) or/and hole(s) provided in a position separated frontwardly (in the direction upstream of the sheet conveyance path) from the rear edge 221 (first edge) of the extension portion 220 may be adopted and implemented in accordance with the present invention as long as the recess(es) or hole(s) serves to allow the distal end portion 120 extending toward the extension portion 220 to be moved without being blocked by the extension portion 220.

In the above-described embodiments, the process cartridge 30 is illustrated by way of example, as a transfer device, but the present invention is not limited to this specific configuration. For example, in an alternative embodiment where a development cartridge by which a development roller is supported and a drum cartridge by which a photoconductor drum and a transfer roller are supported are two separate units to be assembled together, the drum cartridge may be considered to be a transfer device consistent with the present invention. Another alternative may be such that a transfer roller is provided in a main body of an image forming apparatus wherein the special technical feature of the present invention is embodied in the image forming apparatus which is thus can be considered to be a transfer device consistent with the present invention.

In the above-described embodiments, the photoconductor drum 33 is illustrated by way of example, as an image carrying member, but the present invention is not limited to this specific configuration. For example, a belt-type photoconductor may be used with a transfer device configured in accordance with the present invention.

In the above-described embodiment, the sheet 3 (e.g., of paper) such as a cardboard, a postcard, a thin sheet of paper, etc. is taken as an example of a recording medium, but the recording medium consistent with the present invention is not limited thereto, and an OHP sheet or the like may be adopted.

In the above-described embodiment, the transfer roller 35 is taken as an example of a transfer unit, but the transfer unit consistent with the present invention is not limited thereto. For example, a croton-type or scorotron-type mechanism to which a transfer bias is applied may be adopted, instead. Alternatively, the transfer unit may be a conductive brush, a conductive leaf spring, or the like to which a transfer bias is applied.

What is claimed is:

1. A transfer device for transferring developer carried on a peripheral surface of an image carrying member onto a recording medium being conveyed along a medium conveyance path, comprising:

a transfer unit disposed opposite to the image carrying member and configured to transfer the developer from the peripheral surface of the image carrying member onto the recording medium;

a flexible guide plate having a first side and a second side reverse to the first side, the guide plate being disposed in a position along the medium conveyance path, upstream relative to a transfer position that is between the image carrying member and the transfer unit, such that the first side faces to the recording medium being conveyed along the medium conveyance path to guide the recording medium toward the image carrying member, the guide plate including an upstream end portion and a downstream end portion which face in directions upstream and downstream, respectively, of the medium conveyance path, the downstream end portion being an angled portion formed by bending the guide plate; and a support frame configured to support the upstream end portion of the guide plate and to extend in a direction downstream of the medium conveyance path beyond the downstream end portion of the guide plate to form an extension portion which is disposed opposite to the second side of the guide plate and toward which the downstream end portion extends obliquely downstream, the extension portion having a first edge positioned on the medium conveyance path at a side facing in a direction downstream of the medium conveyance path, wherein the extension portion has a recess and/or a hole formed in a position separated, in a direction upstream of the medium conveyance path, from the first edge of the extension portion, to allow the downstream end portion extending toward the extension portion to be moved without being blocked by the extension portion, wherein at least part of the extension portion including the first edge is configured to define the medium conveyance path and guide the recording medium being conveyed along the medium conveyance path.

2. The transfer device according to claim 1, wherein the side of the support frame facing in the direction downstream of the medium conveyance path includes a first end having the first edge and a second end provided in a position separate from the medium conveyance path, the first end being disposed in a position downstream relative to the second end in a direction of conveyance of the recording medium.

3. The transfer device according to claim 1, wherein the extension portion has a supporting surface disposed downstream of the medium conveyance path relative to the recess and/or the hole, the supporting surface being configured to support a rear end of the recording medium being conveyed along the medium conveyance path.

4. A transfer device for transferring developer carried on a peripheral surface of an image carrying member onto a recording medium being conveyed along a medium conveyance path, comprising:

a transfer unit disposed opposite to the image carrying member and configured to transfer the developer from the peripheral surface of the image carrying member onto the recording medium;

a flexible guide plate having a first side and a second side reverse to the first side, the guide plate being disposed in a position along the medium conveyance path, upstream relative to a transfer position that is between the image carrying member and the transfer unit, such that the first side faces to the recording medium being conveyed along the medium conveyance path to guide the recording medium toward the image carrying member, the guide plate including an upstream end portion and a downstream end portion which face in directions upstream and downstream, respectively, of the medium conveyance path, the downstream end portion being an angled portion formed by bending the guide plate; and a support frame configured to support the upstream end portion of the guide plate and to extend in a direction downstream of the medium conveyance path beyond the downstream end portion of the guide plate to form an extension portion which is disposed opposite to the second side of the guide plate and toward which the downstream end portion extends obliquely downstream, the extension portion having a first edge positioned on the medium conveyance path at a side facing in a direction downstream of the medium conveyance path, wherein the extension portion has a recess and/or a hole formed in a position separated, in a direction upstream of the medium conveyance path, from the first edge of the extension portion, to allow the downstream end portion extending toward the extension portion to be moved without being blocked by the extension portion, wherein the recess and/or the hole formed in the extension portion of the support frame are provided in two or more positions spaced out in a direction of a width of the recording medium which is a direction perpendicular to a direction of conveyance of the recording medium, and the guide plate has one or more indentations formed in positions corresponding to those of wall portions left between adjacent recesses or holes in the extension portion to allow the guide plate to be deflected without being blocked by the wall portions.

5. The transfer device according to claim 4, wherein the side of the support frame facing in the direction downstream of the medium conveyance path includes a first end having the first edge and a second end provided in a position separate from the medium conveyance path, the first end being disposed in a position downstream relative to the second end in a direction of conveyance of the recording medium.

6. The transfer device according to claim 4, wherein the extension portion has a supporting surface disposed downstream of the medium conveyance path relative to the recess and/or the hole, the supporting surface being configured to support a rear end of the recording medium being conveyed along the medium conveyance path.

* * * * *